United States Patent [19]

Schupack et al.

[11] Patent Number: 4,896,786

[45] Date of Patent: Jan. 30, 1990

[54] SHIPPING CONTAINER FOR EDUCATIONAL MATERIALS AND THE LIKE

[75] Inventors: Jay M. Schupack, Bellevue, Wash.; Alan Biggs, Victoria, Canada

[73] Assignee: Comprehensive Health Education Foundation, Seattle, Wash.

[21] Appl. No.: 226,463

[22] Filed: Aug. 1, 1988

Related U.S. Application Data

[62] Division of Ser. No. 102,880, Sep. 30, 1987.

[51] Int. Cl.[4] ..... B65D 43/14

[52] U.S. Cl. ..... 220/338; 220/337

[58] Field of Search ..... 220/337, 340, 334

[56] References Cited

U.S. PATENT DOCUMENTS 3,663,990 5/1972 Shane .

4,452,373 6/1984 Pearce et al. ..... 220/337

4,527,825 7/1985 Clouse ..... 220/337

4,697,720 10/1987 Hotchkiss et al. ..... 220/337

*Primary Examiner*—Joseph Man-Fu Moy

*Attorney, Agent, or Firm*—Graybeal, Jensen & Puntigam

[57] ABSTRACT

A container which includes a lower body portion to receive articles and an upper lid portion which forms a top for the body portion. An upstanding rib is provided along the upper edge of the body which is received into a mating channel on the lower edge of the lid. The lid is hinged to the body and clamps are included which secure the lid to the body. The body includes a horizontal rib which extends outwardly from the body in the vicinity of the upper edge thereof, while the lid includes a mating horizontal rib which extends outwardly in the vicinity of the lower edge thereof. Both the lid and the body include an indented portion in the front surface approximately central thereof. A portion of the horizontal rib of the body extends across the opening defined by the indented portion, thereby forming a handle for the container.

3 Claims, 2 Drawing Sheets

FIG. 1
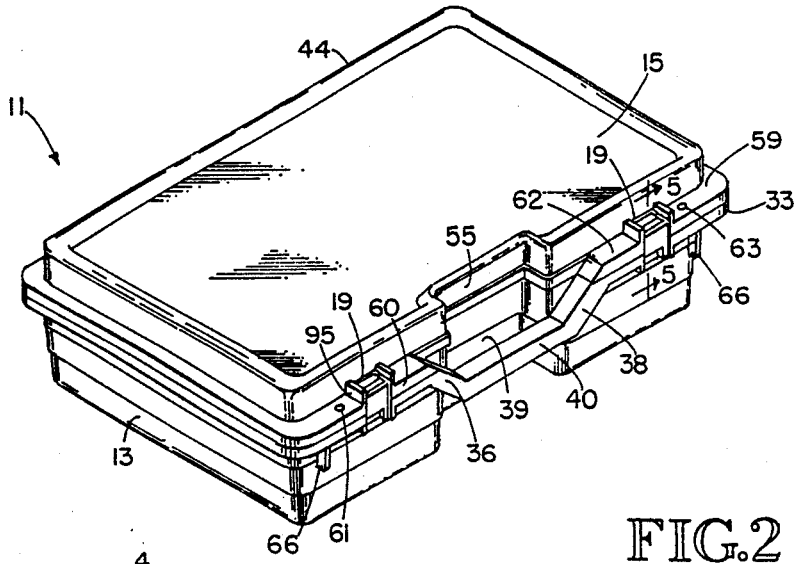
FIG. 2
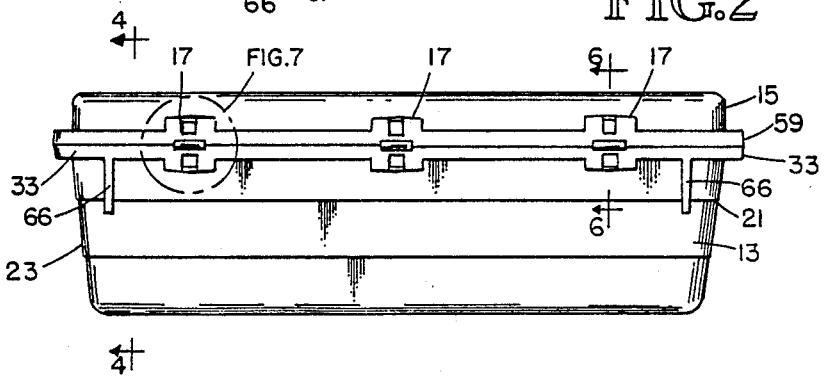
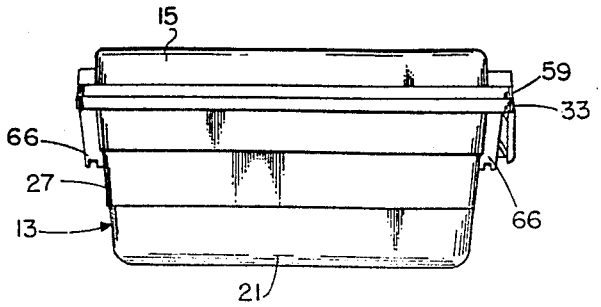
FIG. 3

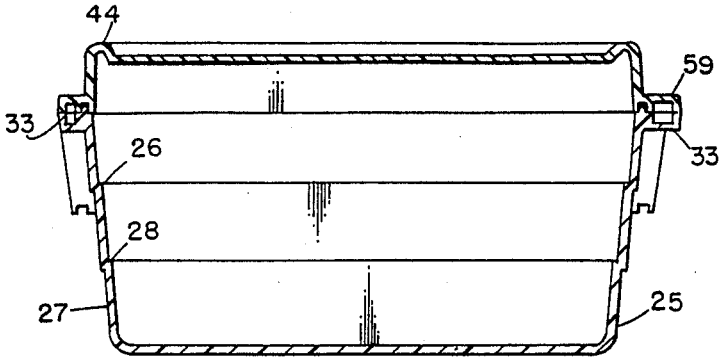
FIG. 4
FIG. 5
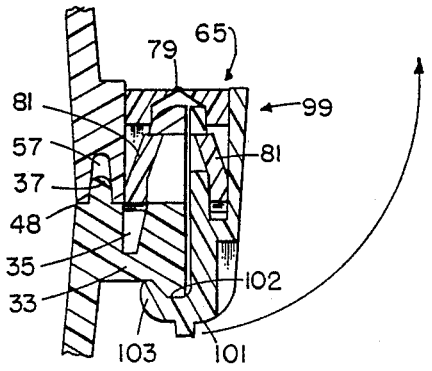
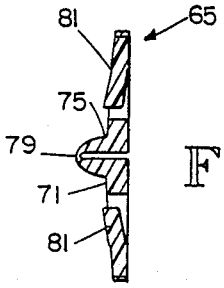
FIG. 6
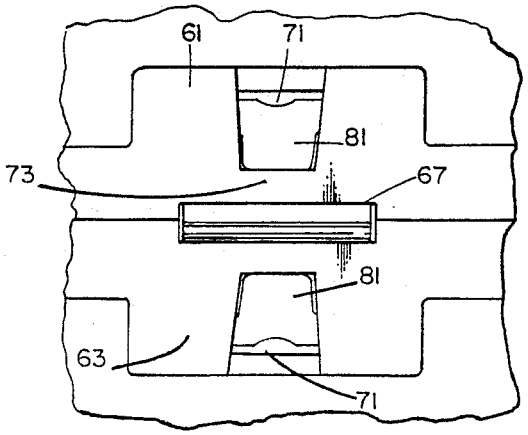
FIG. 7

SHIPPING CONTAINER FOR EDUCATIONAL MATERIALS AND THE LIKE

This is a divisional of application Ser. No. 102,880 filed on Sept. 30, 1987.

DESCRIPTION

1. Technical Field

The present invention relates generally to the art of containers and more specifically concerns a rigid container which comprises a body portion and a hinged lid portion, the resulting container being suitable for shipment and storage of educational materials, and the like.

2. Background Art

The art of containers is quite active and crowded. Many novel containers have been developed to solve particular problems and/or to satisfy special needs. The container described herein was developed for the convenient shipment and subsequent storage of educational materials, including printed materials, audio and video tapes and film, and special purpose items such as puppets and the like. It was desirable that the container be relatively lightweight, of a certain size, and have a top which is convenient to open. Structural integrity was also important. Further, the container had to be convenient to carry. No containers known to applicant satisfied such criteria.

DISCLOSURE OF THE INVENTION

Accordingly, the present invention is a container which includes a lower body portion which is open at the top, the body portion capable of receiving articles therein, such as educational materials and the like. The body portion includes a first circumferential rib which extends outwardly from the exterior surface of the body portion in the vicinity of the upper edge thereof. The container also includes an upper lid portion which is movably secured to the body portion, the lid portion forming a top for the body portion. The lid portion includes a second circumferential rib in the vicinity of the lower edge thereof, wherein the first and second circumferential ribs abut each other when the lid portion is closed on the body portion, the lid and body portions having similar dimensions. Both the lid and body portions include an indented portion in the respective front walls thereof, extending substantially from the top to the bottom of the container. The first circumferential rib is extended across the indented portion, forming a handle for the container. Clamps are also provided for securing the lid portion to the body portion.

BRIEF DESCRIPTION OF THE DRAWINGS

FIG. 1 is an isometric view of the container of the present invention.

FIG. 2 is a rear view of the container of FIG. 1.

FIG. 3 is an elevational view of the container of FIG. 1.

FIG. 4 is a cross-section view taken along lines 4—4 in FIG. 2.

FIG. 5 is a partial cross-section view taken along lines 5—5 in FIG. 1.

FIG. 6 is a cross-section view of the hinging element, taken along lines 6—6 in FIG. 2.

FIG. 7 is an elevational view showing the hinge structure used in the container of FIG. 1.

BEST MODE FOR CARRYING OUT THE INVENTION

FIGS. 1 through 4 show in general the container 11 of the present invention. Container 11 comprises a lower body portion 13 and an upper lid portion 15. Body 13 is configured to receive articles while lid 15 provides a cover or top for the body 13. Lid 15 is rotatably attached to the body 13 by means of hinges 17—17 positioned along the rear edge thereof. The lid 15 is secured to the body 13 at the front edge thereof by means of clamps 19—19. The structure of the hinges and clamps, respectively, is discussed more in detail below and is shown in FIGS. 5 through 7.

FIGS. 1 through 4 are now referred to in detail with respect to the following description concerning the body portion 13 of the container. The body 13 is comprised of a rigid, high impact plastic, such as polyethelene. It is basically rectangular in configuration, having top dimensions of approximately 25 ½ inches by 14½ inches, and a depth of 6½ inches. Each of the side walls 21, 23 of the body 13 as well as the front and rear walls 25 and 27, slope slightly inwardly from the top of the body 13. As a consequence, the bottom of the container is approximately 24 inches by 13 inches.

There are two horizontal circumferential lips 26, 28 (FIG. 4) around the interior surface of the body 13. The lips, which are approximately ⅛th inch wide in the embodiment shown, occur at depths of approximately 2 inches and 4 inches, respectively, below the top edge of the body 13. Since the walls of the body 13 are of uniform thickness, approximately ¼ inch in the embodiment shown so as to be durable and puncture-resistant, the interior lips are seen as corresponding small circumferential overhangs on the exterior surface of the body. This gives the exterior of the body a "lapped" appearance. With the exception of the circumferential lip/overhang described above, the walls and bottom of the body 13, both inside and out, are flat and smooth. The tapered configuration permits the containers of the present invention to be nested together, when the lids are open. Notched depending elements 66—66, located approximately at the corners of a given container abut the interior surfaces of the next lowest container, preventing the containers from jamming.

Positioned around the top edge of the body, extending horizontally outwardly from the walls thereof, is a horizontal circumferential rib 33. Rib 33, which is integral with and comprises the same material as the body 13, generally extends outwardly from the walls of the body approximately ⅝ inch, and is approximately ½ inch high. Located in the upper surface of the rib 33, approximately central thereof, is a channel 35 (FIG. 5) which in the embodiment shown is approximately ¼ inch deep and of somewhat varying width.

Extending upwardly from the top edge of the body 13 is a small vertical rib 37, which in the embodiment shown is approximately 3/16 inch high and slightly greater than ⅛ inch at its base. The rib 33 narrows as it extends upwardly and has a slightly rounded top. The vertical rib 37 engages with a mating surface in the lid 15 as will be discussed hereinafter.

The front wall 25 of the body 13 includes an indented portion 39 which extends vertically from the top of the body to the bottom thereof, as shown clearly in FIG. 1. The indented portion 39 is approximately central of the front wall 25 and at the top of the body, and is approximately 6 inches long by 1¼ inches deep in cross-section.

The cross-section dimensions of the indented portion are constant from the top edge of the body portion 13 to the upper circumferential lip 26 thereof, at which point the dimensions of the indented portion gradually increase, with the two side surfaces thereof sloping outwardly, and the rear surface thereof sloping inwardly of the container.

Still referring to the body structure 13, at a point approximately 1½ inches outwardly from each of the side surfaces of the indented portion 39, the horizontal rib 33 angles downwardly at an angle of approximately 45°, until it reaches the indented portion, at which point the rib 33 continues horizontally, spanning the indented portion 39 and forming in effect a handle for the container. The angled portions 36, 38 it should be understood, are still integral with the body. The portion 40 of the rib 33 which spans the indented portion 39 is square in cross-section, approximately 1 inch on a side, which leaves a space of approximately 1¼ inches between portion 40 and the rear surface of the indented portion. The portion of circumferential rib 33 adjacent the front surface, angled portions 36, 38 and handle portion 40 are all in the same plane in the embodiment shown.

The lid portion 15 is also shown with particularity in FIGS. 1 through 4. The lid 15 is comprised of the same material as the body 13, and is hence also resistant to breakage and/or puncture. The lid is also rectangular in cross-section, approximately 25½ inches by 14½ inches, the same dimensions as the upper edge of the body 13. The lid portion is 1¾ inches deep in the embodiment shown.

The lid has a rounded rib or protrusion 44 around the top edge thereof, the rib 44 curving downwardly at its inboard side a short distance to the upper surface of the lid, which is flat and smooth, both inside and out. The outline dimensions of the inner edge of rib 44 are the same or slightly greater than the dimensions of the lower surface of the body portion 13, so that the containers can be conveniently stacked together.

The front wall of lid 15 has an indented portion 55 which matches the indented portion 39 of the body. The lower edge 48 of the lid includes a narrow channel 57 (FIG. 4) which is configured and arranged to receive the vertical rib 37 which extends from the upper edge of the body. This arrangement provides a seal between the body and the lid. The entire container could be made easily watertight by the inclusion of an O-ring or similar element in the channel 57.

Extending horizontally outwardly from the lower edge 48 of the lid is a horizontal rib 59 which mates with the horizontal rib 33 of the lower body portion. The horizontal rib 59 terminates in two small opposing angled portions 60,62 at the front surface of the lid, mating with the upper ends of angled portions 36, 38 of the horizontal rib of the body.

Two vertical holes 61 and 63 are located in the ribs 59 and 33 adjacent the front surface of the respective body and lid portions and similar holes are provided in the ribs 59 and 33 adjacent the rear surfaces thereof. A strong plastic or wire retaining element can be positioned through the opening, adding to the security and integrity of the container when the lid 15 is down against the body.

The following description concerns the hinge and clamp elements which secure the lid and body together, shown in FIGS. 2, and 5–7. There are three hinges 17—17 in the embodiment shown, all of which are identical, positioned along the mating surfaces of the lid and body at the rear of the container. Each hinge includes a particularly configured portion 61, 63 of the ribs of both the lid and the body, and a hinging element 65 (FIG. 6) which is received in the respective rib portions and provides the hinging effect. Referring specifically to FIG. 7, each rib hinge portion 61,63 includes a cut-out portion 67 which extends approximately ½ of an inch upwardly into the rib, and inwardly of the rib approximately ⅜ inch. An interior opening 69 approximately 1¼ inches by ⅛ inches in cross-section extends upwardly into the rib portion approximately ¾ inch from the cut-out portion 67, but also opens outwardly through the rib portion in the form of an opening 71 which is approximately ½ inch by ⅝ inch, leaving a narrow bar-like portion 73 at the bottom of opening 71.

The hinging element is rigid plastic, comprising two identical clip-like, L-shaped sections 75, 77 joined at the free end of their respective base sections by a narrow, thin flexible web 79 permitting the two L-shaped sections 75, 77 to move relative to each other. Each L-shaped section includes a rigid ear section 81 which depends from the free (upper) end of the vertical leg portion of each L-shaped section. In assembly, the depending ear 81 is squeezed against its adjacent vertical leg portion of the L-shaped section and inserted into the opening 69 in the associated rib hinge portion. The depending ear 81 then springs outwardly into the opening 71, the lower edge of the ear 81 abutting the upper edge of the bar-like portion 73. Each L-shaped section fits into vertically adjacent rib hinge portions, being firmly held therein. The thin web portion 79 permits rotation of the lid relative to the body because the L-shaped sections of the hinge are firmly captured within the hinge portions in each rib.

The two clamps 91, 93 at the front of the container (FIG. 5) also each include a hinging element identical to that described above. The hinging element 65 is connected between the upper edge of each rib clamp portion 95 (FIG. 1) in horizontal rib 59 and the upper edge of a clamping element 99 so that the clamping element 99 in operation pivots or rotates relative to the upper edge of the rib clamp portion.

The lower edge 101 of the clamping element 99 curves inwardly in the form of a semicircle, with a small bulge or bead along the free end 103 thereof. The lower edge of the rib clamp portion in horizontal rib 33 has a depending bead 102 which is configured to mate with the curved portion at the bottom of the clamping element 99. The dimensions of the respective elements are such that pressure is required to force the curved end of the clamping element 99 back under the lower edge of the rib clamp portion of horizontal rib 33, i.e. under and to the rear of bead 102.

In this position, the clamping element, which is rotatably secured to lid rib 59, is essentially locked to the body rib 33. When the lid is to be opened, the lower edge of the clamping element 99 is pulled out from under the lower edge of rib 33, i.e. away from bead 102, thereby freeing the clamping element, which may be then rotated upwardly. The lid may now be opened. This has proven to be a reliable, strong and effective way of clamping and locking the lid to the body, without the use of conventional metal hinges. It should be understood that although the clamp is described relative to locking the lid rib to the body rib, it could be the opposite, i.e. the clamping element could be attached to the body rib which in turn is locked to the lid rib.

Therefore, a container has been described which has a structure and configuration advantageous for a particular purpose. Although the container described herein is adapted to carry educational materials, it should be understood that other articles may be conveniently carried in the container as well.

Although a preferred embodiment of the invention has been disclosed herein for illustration, it should be understood that various changes, modifications and substitutions may be incorporated in such embodiment without departing from the spirit of the invention as defined by the claims which follow.

What is claimed is:

1. A hinge, which is useful with a container having a body portion and a lid portion, the lid portion forming a top for the body portion, comprising:

a hinging element comprising two rigid clip-like portions joined by a narrow, central, flexible web-like portion, such that the clip-like portions are rotatable about said web-like portion;

hinge mounting elements located on abutting sections of said lid and body portions of the container, the hinge mounting elements including interior cavities configured so as to open onto edges of the respective hinge mounting elements which are immediately adjacent to each other when the lid and body portions are abutting, thereby defining abutting edge openings, each interior cavity including a clip retaining portion, wherein the clip-like portions of the hinging element are configured so as to be insertable into the interior cavities of the lid and body hinge mounting elements, respectively, through the edge openings thereof, and wherein the free end of each clip-like portion includes an end section which abuts the clip-retaining portion in the hinge mounting elements so as to tend to prevent removal of the clip-like portions from the hinge mounting elements.

2. An article of claim 1, wherein each clip-like portion is formed substantially in the shape of an L comprising a vertical leg portion and a horizontal leg portion, with the end section thereof extending from the top edge of the vertical leg portion downwardly toward the horizontal leg portion and slightly outwardly from the vertical leg portion, such that pressure on the end section will result in the end section being moved back against the vertical leg portion and removal of such pressure will result in the end section springing back to its original position.

3. An article of claim 2, wherein the hinge mounting element includes an opening extending outwardly from the interior cavity, the lower edge of the opening defining the clip retaining portion.

* * * * *

UNITED STATES PATENT AND TRADEMARK OFFICE

CERTIFICATE OF CORRECTION

PATENT NO. : 4,896,786

DATED : January 30, 1990

INVENTOR(S) : Alan Biggs

It is certified that error appears in the above-identified patent and that said Letters Patent is hereby corrected as shown below:

On the title page, item [75], the inventorship should be --Alan Biggs-- (sole), rather than "Jay M. Schupack" and "Alan Biggs".

Signed and Sealed this

Thirtieth Day of April, 1991

*Attest:*

HARRY F. MANBECK, JR.

*Attesting Officer*

*Commissioner of Patents and Trademarks*